United States Patent [19]

Lauener

[11] Patent Number: 4,823,860

[45] Date of Patent: Apr. 25, 1989

[54] ROLL CASTING PROCESS AND ROLL CASTING SYSTEM FOR CARRYING OUT THE PROCESS

[75] Inventor: Wilhelm F. Lauener, Gerlafingen, Switzerland

[73] Assignee: Larex AG, Recherswil, Switzerland

[21] Appl. No.: 12,347

[22] Filed: Feb. 9, 1987

[30] Foreign Application Priority Data

Feb. 13, 1986 [CH] Switzerland ..... 581/86

[51] Int. Cl.[4] ..... B22D 11/06; B22D 11/124

[52] U.S. Cl. ..... 164/480; 164/428; 164/486; 164/444

[58] Field of Search ..... 164/428, 440, 480, 481, 164/486, 444

[56] References Cited

U.S. PATENT DOCUMENTS 3,498,362 3/1970 Lewis ..... 164/480
4,194,553 3/1980 Kimura et al. ..... 164/486

FOREIGN PATENT DOCUMENTS 898135 11/1953 Fed. Rep. of Germany ..... 164/428
59-118247 7/1984 Japan .

*Primary Examiner*—Kuang Y. Lin
*Attorney, Agent, or Firm*—Marks Murase & White

[57] ABSTRACT

A flow of coolant is injected or blown into spaces bounded by a cast strip the point of minimal separation between the rolls, and the rolls themselves. The coolant is injected or blown by means of nozzles disposed on both sides of the strip. In the case of an asymmetric emergence of the strip due to increased adhesion to one of the rolls, the resulting asymmetric conditions cause the strip to continually be redirected into a symmetric position. This stabilizing effect renders it possible to achieve a much greater length of contact between the cast metal and the rolls and consequently to realize the essential increase of the production rate of the casting line.

11 Claims, 2 Drawing Sheets

ROLL CASTING PROCESS AND ROLL CASTING SYSTEM FOR CARRYING OUT THE PROCESS

BACKGROUND OF THE INVENTION

The present invention deals with a roll casting process whereby metal is continuously cast between cooled, counter rotating rolls, subsequently to emerge from the gap between the rolls as a solidified strip; The process includes providing a flow of coolant along the roll surface, in the direction of the roll gap and on both sides of the cast strip. The coolant is then drained off in the direction of the cast strip and along the cast strip so that the strip sticks to one of the rolls, which results in more intense cooling on the opposite side of the strip. This causes asymmetric heat tension in the strip with reference to its center line and thus creates a bending moment in the strip which causes a detachment of the strip from a sticking roll.

By means of so called roll casters the process referred to has found industrial application since the third decade of this century, its significance greatly increasing since 1955 (D. E. Herrmann, *Handbook on Continuous Casting,* 1980 Ed.)

The thickness of the cast strip resulting from systems built to date lies in the range of 3 to 5 mm, usually measuring 6 to 8 mm; and more recent production lines cast a strip measuring from 0.25 to 2 m in width. However, with appropriate dimensioning of the rolls, of their bearings, and of the drives, the casting process itself presents no limits as to the width of the strip being cast and it is quite feasible to cast strips with a width of 3 to 4 m.

The following description, referring as an example to the casting of aluminum, is also valid by adjustment of the corresponding data for analogous applications of the roll casting process to other materials, especially steel.

So far the process of roll casting has been mainly applied for the production of aluminum strips, allowing for an hourly production rate of 900 to 1200 kg per m of strip-width, depending on the thickness and the alloy of the cast strip. The strip thus cast emerges from the roll-gap with a speed, generally called casting speed, of 0.75 to 1.4 m/min. Having emerged from the rolls, the cast strip usually has a temperature of 300 to 400 degrees centigrade.

Any direction of casting is possible. We know of systems casting straight upward, horizontally or at an angle, be it upward or downward.

The rolls are combined with a cooling system allowing for the acquired heat to be carried off by means of a coolant. For this purpose, the internal cooling of the rolls has so far prevailed, the rolls being placed inside a shell and featuring grooves through which the coolant circulates. It is also possible, however, to use external systems whereby the surface of the rolls is directly contacted by the coolant and dried before reentering the casting zone (Sir Henry Bessemer, 1846).

Every applicant of the casting process strives to achieve the highest possible production rate, i.e. to run the system at the highest possible casting speed. It is required that no liquid metal passes through between the rolls, as this would interrupt the casting process or at least create strong disturbances until the breakthrough of liquid metal is stopped by varying of the casting parameters (decrease of casting speed and/or decrease of metal temperature in the feed system; cleaning of the roll surfaces etc.).

Since the required contact time between the rolls and the metal being cast is determined by the alloy and the thickness of the cast strip along with the thermal conditions (heat flow), it is reasonable to increase the length of contact between the rolls and the metal being cast by moving the nozzle back (increase of the distance h in FIG. 1) and at the same time increasing the casting speed without going below the necessary contact time.

Experience shows that solidification of the molten metal over the width of the cast strip can take place at somewhat differing speeds. This is caused by small variations in the heat flow due to temporal and/or local differences in the roll surface, e.g. as a result of the nozzle's rubbing on the rolls and/or variations of the temperature in the coolant or in the liquid metal or other cirumstances.

In order to avoid with all certainty a breakthrough of liquid metal, it is expedient to allow for a certain distance (distance a in FIG. 3) between the point of complete solidification of the cast metal and the point of emergence from between the rolls.

With today's casting speeds as mentioned above and with a thickness of the cast strip of approximately 6 mm (with reference to aluminum) a distance (h) of approximately 30 mm between nozzle aperture and emergence from between the rolls has proven to be appropriate (FIG. 3), the average distance (a) thereby amounting to approximately 12 mm. Due to the reasons mentioned above, this distance can vary within a range of approximately 8 to 16 mm across the width of the cast strip and in the course of time.

The process therefore includes a slight rolling effect after the complete solidification of the cast metal. Assuming for example a diameter of 600 mm for the rolls, the distance of a=12 mm will result in a reduction rate of 7.4%. With a local minimum of a=8 mm the reduction rate will amount to 3.4% and for the maximum of a=16 mm it amounts to 12.4%.

Experience shows that with this rolling effect on dry, non-lubricated rolls having very high surface-temperature the cast strip , while still soft has the tendency to stick to the rolls. The strip emerging from between the rolls has the basic tendency to move away from the rolls in the plane of symmetry. If the adhesion to one of the rolls is greater than to the other and if the difference exceeds a permissible value mainly dictated by the flexural strength of the strip at the point of emergence from between the rolls, the strip will stick to the one roll and must be loosened by force usually applied by means of scrapers or corresponding high strain in the strip. This strongly reduces the quality of the strip, to the effect that by today's high quality requirements it is rendered useless for most applications. To a certain extent the danger of sticking can be reduced by spraying the rolls with a readily evaporating liquid such as suspended graphite, molybdenum disulphide, boron nitride, magnesium oxide etc. which serve as stripping agents.

If for example the casting speed is 1.2 m/min and the distance between nozzle aperture and point of emergence from between the rolls h=30 mm (FIG. 3), the average contact time between cast metal and the rolls amounts to 1.5 s. This time is composed of the average time for solidification, 0.9 s (length of the solidification zone b=18 mm, FIG. 3) and the average rolling time, 0.6 s (length of the rolling zone a=12 mm, FIG. 3).

Considering a casting process in view of these durations it becomes obvious that an increase in casting speed with constant durations for the individual phases (solidification, rolling) requires an increase in the distances a, b and h (FIG. 3). Maintaining the same roll diameter, an increase in casting speed therefore results in an increase of the rolling effect and of the strip deformation. The resulting increased rolling pressure causes the strip to adhere more strongly to the rolls despite the application of above mentioned stripping agents, the permissible difference in adhesion between the strip and each of the rolls being exceeded at least from time to time, thus causing the strip to stick to one of the rolls and having to be loosened as described above by applying external force.

SUMMARY OF THE INVENTION

The purpose of the invention is to present a process producing a high stability of the soft strip at the point of emergence from between the rolls, causing the strip to come off the rolls and to be freely directed forward despite strong and differing adhesion, thus allowing for a significantly greater length of contact between the cast metal and the rolls, the final result being an essential increase of the production rate of a casting line. At the same time intense secondary cooling of the strip at the point of emergence from between the rolls is to be achieved in order to prevent the breakthrough of liquid metal. The present invention provides a solution to this problem. According to the invention, a flow of coolant 21 is applied along the roll surface, in the direction of the roll gap and on both sides of the cast strip 6. The coolant is then drained off in the direction of the cast strip and along the latter to the effect that sticking of the strip 6 to one of the rolls 1,2 results in more intense cooling on the opposite side of the strip, causing asymmetric heat tension in the strip with reference to its center line and thus creating in the strip a bending moment which causes a detachment of the strip from the roll to which it is adhered. The coolant is drained off through either of two gaps 20*a*, 20*b*, each of which are bordered by a nozzle-wall 8 and the strip 6. The coolant is dammed up, the degree of its respective congestion depending upon the position of the cast strip 6.

Applying the coolant is expediently achieved by means of nozzles located on both sides of the strip, one wall of each nozzle being advantageously formed by the corresponding roll surface itself.

It is advantageous to apply the process according to the invention together with a further external cooling system for the rolls. Within the cooling zone the roll surface is moistened, sprayed, or blown with a coolant over part of its circumference The roll surface is thereby cooled using the coolant directly at the end of the casting zone.

A drying zone immediately following the cooling zone assures that the roll surface is dry upon reentry into the casting zone.

It is possible to add to the coolant the above mentioned or other stripping agents which will dry at the surface of the rolls consequently decreasing the adhesion between the cast strip and the rolls.

Drying of the roll surfaces can be accomplished by familiar means such as strippers and/or brushes, possibly supported by blowing cold or warm air in order to accelerate the final evaporation of a liquid coolant on the roll surface previously heated by the casting process.

BRIEF DESCRIPTION OF THE DRAWINGS

The invention will now be discussed in detail using a drawing which corresponds to the roll casting system representing the invention.

DETAILED DESCRIPTION OF THE INVENTION

Figure 2:
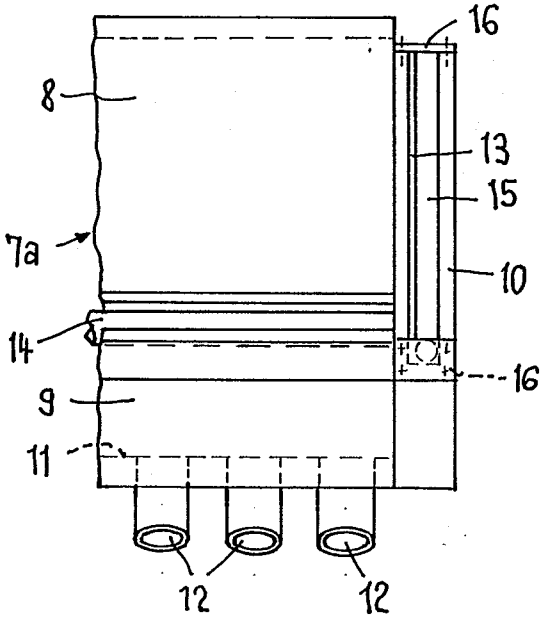
FIG. 2 represents in part a side-view of a coolant nozzle with the roll removed.
Figure 1:
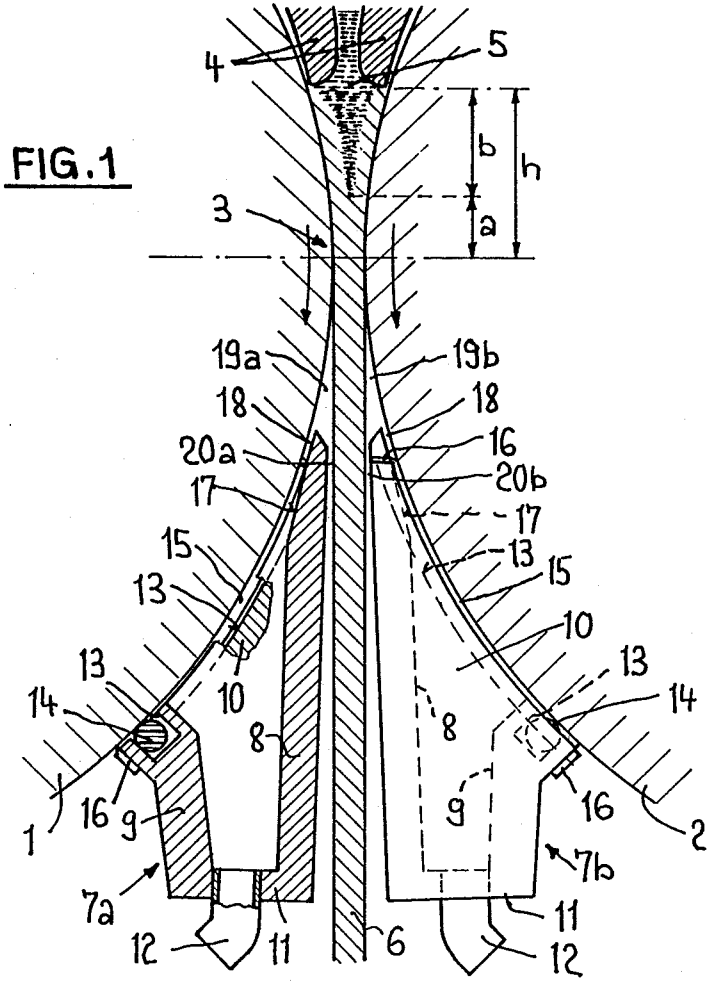
FIG. 1 represents a cross section of the essential part of the system.
Figure 3:
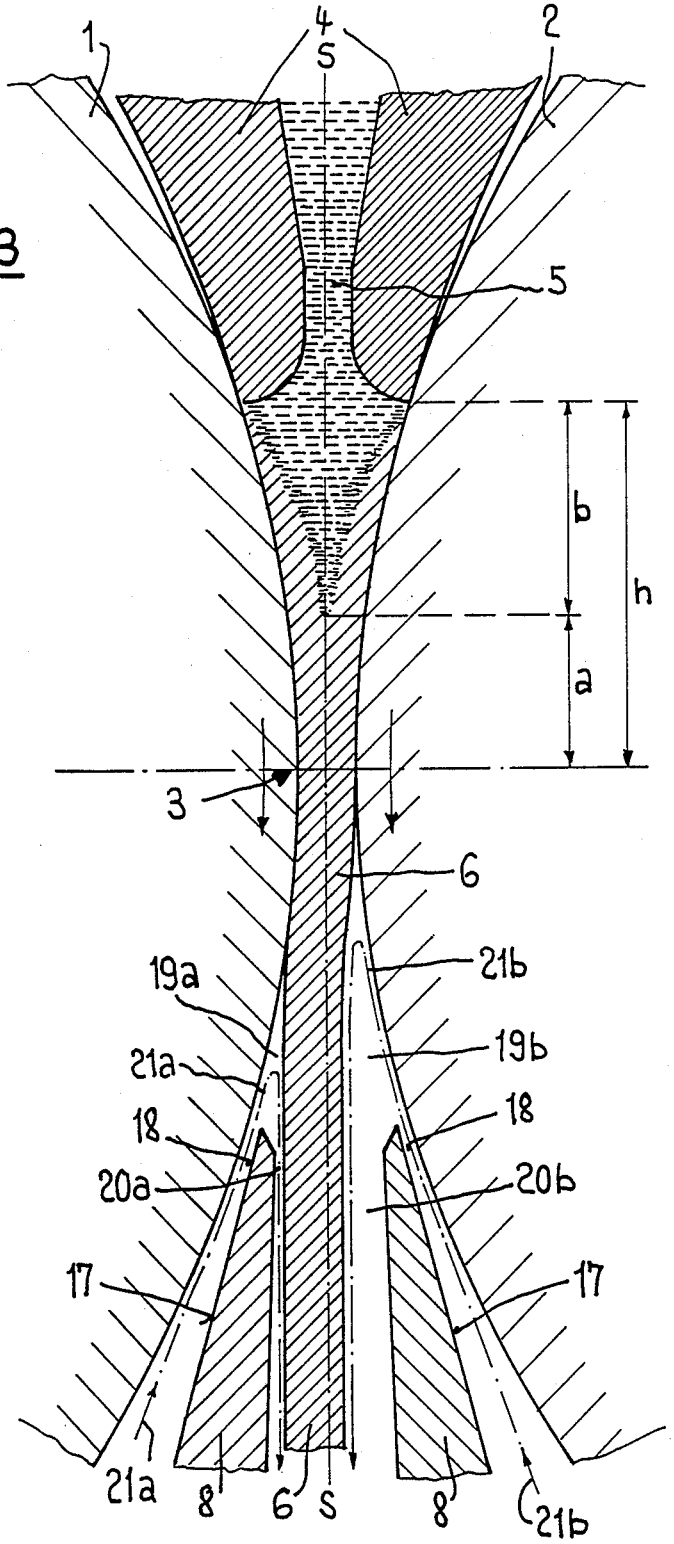
FIG. 3 represents a partial section as basis for discussing the stabilizing procedure as achieved by means of the coolant flow.

The system represented by FIGS. 1 and 3 comprises casting rolls 1 and 2 that are counter rotating and can be driven in the direction of the arrows indicated in FIGS. 1 and 3. In front of the narrowest space 3 between the rolls 1 and 2 , which space will be called roll gap or simply gap in the following, lies a casting nozzle of which two sidewalls 4 are marked in the figures. Through this nozzle liquid metal 5 is directed into the system to be distributed sideways below the nozzle 4 and cooled at the surface of the rolls. Thereby the metal solidifies within the zone of solidification b then to be rolled as explained above within the rolling zone a. The rolled strip 6 exits downward through the roll gap 3 and is further directed by familiar means not represented in the figure. So far the system corresponds to those known and initially described.

According to the invention a nozzle for the coolant 7*a* and 7*b* is placed on each side of the strip 6 below the roll gap 3. Each of these nozzles comprises a nozzle body formed by an inner wall 8 and an outer wall 9, two opposite end walls 10 which close the nozzle body off at the ends, and a back wall 11. At the back wall, connecting pieces 12 allow for coolant, preferably water, to be applied in certain amounts and under certain pressure through feed pipes not represented in the drawing. The two nozzle bodies are covered in the front by the corresponding roll 1,2 which thus represents a wall of the nozzle body. To achieve sealing between the nozzle bodies 7 and the surface of the rolls, grooves 13 into which sealing rods 14,15 can be placed can be worked into the edges of the outer nozzle walls 9 and the end walls 10. As shown in FIG. 1 these sealing rods are loosely situated in the grooves 13, thus allowing for the pressure of the coolant during the casting process to press them into the sealing position as shown in FIG. 1. The sealing rods 14 are straight and the friction between the rougher roll surface and the rods normally being greater than that between the rods and the cleanly worked surfaces of the grooves, the sealing rods will be caused to rotate during operation, the result being less wear than by constant sliding against the roll surface. The sealing rods 15, on the other hand, must of course rub against the surface of the rolls. The sealing rods 14,15 consist of metal or synthetic material. The axial grooves 13 in the outer side walls 9 run into the circumferential grooves 13 within the end walls 10. The grooves 13 in the end walls 10 are closed off on both ends by a lid 16.

Each roll surface together with the corresponding slanted upper part 17 of the inner side wall 8 creates the borders of a nozzle with a slot-shaped aperture 18 in axial direction along a generating line of each roll. Through these apertures a stream of coolant can be pumped or blown in tangential or circumferential direction along the surface of the rolls into the spaces 19*a*, 19*b* bordered by the nozzles, the rolls, the gap 3 and the strip 6. From these spaces the coolant flows off through the slot-shaped exits 20*a*, 20*b* between the side walls 8 and the cast strip 6. These exits are relatively tight, causing the coolant to be dammed in the spaces 19*a* and 19*b*, thereby creating a certain pressure.

In FIG. 1 it is assumed that the strip 6 exits from between the rolls 1,2, respectively the roll gap 3, symmetrically and moves on between the two nozzles 7*a* and 7*b* also symmetrically. The conditions concerning the flow of coolant and its effect are therefore also symmetrical, which means that both sides of the cast strip are equally cooled. The pressure in the coolant occupying the spaces 19*a* and 19*b* is also equal, and consequently there is the same pressure on both sides of the cast strip. The simplified representation in FIG. 3 with only the very upper part of the actual side walls 8 of the nozzles shown demonstrates the situation in which the cast strip 6 adheres more strongly to the roll 1 than to the roll 2, therefore emerging from between the rolls respectively from the roll gap in asymmetrical manner. As a result of the spaces 19*a*, 19*b* as well as the flow and cooling conditions within these spaces, are likewise asymmetrical. FIG. 3 indicates the flow of coolant by lines 21*a*, 21*b*. Obviously the bordering side of the strip 6 within the smaller space 19*a* is being cooled along a much shorter stretch than that in the opposite space 19*b*. This more intensive cooling on one side of the strip produces a much stronger contraction on the right hand side of the strip. As a result, the heat tension creates a bending moment which is asymmetrical with respect to the center line of the strip. Consequently, a deformation in direction of the cooler side of the strip causes the strip to be continually loosened from the roll to which it adhered, and to be directed towards a symmetrical and stabilized condition.

A further stabilizing effect is achieved by the fact that the pressure in the space 19*a* increases more strongly than the pressure in the opposite space 19*b*. FIG. 3 clearly shows that the exit between the strip 6 and the nozzle wall 8 is essentially smaller on the left side than on the right. A higher pressure in the coolant will build up on the left side of the strip and even though this higher pressure is being applied to a somewhat smaller surface area of the strip than the lower pressure on the right side, there results a force onto the strip pushing it to the right (FIG. 3).

The narrowing of the exit opening 20*a* furthermore causes a reduction of the coolant flow on the left side, thus additionally decreasing the cooling effect on the left side of the strip. It is therefore the combined influence of several factors that continually causes a symmetrical positioning of the strip 6 with respect to the center line S—S (FIG. 3) after the strip emerges from the roll gap 3. A further result of the applied invention is the increased cooling of the rolls and of the strip relatively closely to the solidification zone, a fact which again contributes to the practicability of increased casting speed.

Corresponding effects can also be achieved in a somewhat different manner or they can be intensified by additional measures. It is feasible to apply nozzles featuring a nozzle wall reaching as far as the nozzle aperture and running along the curvature of the rolls. This design would feature the advantage of not requiring any sealing elements between nozzle and rolls. Depending upon the specific circumstances, applying this type of nozzle could present certain difficulties with respect to the required space. With proper means it is also possible to control the flow of coolant. One could for example measure the position of the strip 6, the pressure in the spaces 19*a* and 19*b* or the temperature in these spaces and, based on this data, control the flow of coolant to the effect that the situation as represented in FIG. 3 would cause a reduction of the coolant flow on the left side of the strip and an increase on the right side. However, as mentioned above, the situation not necessarily being the same over the whole width of the strip or along the full length of the rolls, the self-adjusting mode as described above has the advantage that the proper influence automatically takes effect locally or over the whole width of the strip. The arrangement as drawn, featuring a strip running vertically from top to bottom probably represents the most advantageous solution. However, it is possible to apply the process representing the invention for any given casting direction. In case of a non-vertical casting direction it is possible to use differently dimensioned cooling nozzles or flow volumes of the coolant in order to compensate for the weight of the cast strip.

Instead of loosely placing the sealing rods 14,15 in grooves 13 it is also possible to use fixed sealing strips, preferably consisting of rubber-elastic material or a familiar type of labyrinth seals.

What I claim:

1. A roll casting process for continuous casting of a metal strip comprising the steps of:

injecting molten metal between a first and a second rotating roll which produce a solidified metal strip;

disposed first and second barriers between said solidified metal strip and said first and second rotating rolls, respectively;

providing a continuous flow of coolant along a first coolant flow path in a first space substantially bounded by said first barrier, said first rotating roll, and said solidified metal strip, and along a second coolant flow path in a second space substantially bounded by said second barrier, said second rotating roll, and said solidified metal strip;

measuring a parameter indicative of said solidified metal strip position; and adjusting said coolant flow in response to said parameter, whereby said solidified metal strip is forced into a symmetrical position.

2. The method according to claim 1, wherein said first and second coolant flow paths vary as a function of a position of said solidified metal strip.

3. The method according to claim 1, wherein said step of providing a continuous flow of coolant comprises injecting said coolant under conditions sufficient to create a dam of coolant in gaps disposed along said first and second coolant flow paths.

4. The method according to claim 1, wherein said parameter is a temperature of said coolant.

5. The method according to claim 1, wherein said parameter is a pressure of said coolant within said first and second spaces.

6. The method according to claim 1, wherein said parameter is a position of said solidified metal strip.

7. A roll casting system comprising:

a molten metal supply means for providing a source of molten metal;

first and second rotating roll means for receiving molten metal from said molt®n metal supply means and for producing a solidified metal strip into a receiving area;

first and second barrier means disposed between said first and second rotating rolls, respectively, and said receiving area;

coolant supply means for supplying a continuous flow of coolant along a first and second coolant flow path bounded by said receiving area, said first and second rotating rolls, respectively, and said first and second barriers, respectively; and measuring means for measuring a parameter indicative of said solidified metal strip position;

wherein said coolant supply means adjusts said coolant supply in response to said measuring means so as to force said solidified metal strip into a symmetrical position.

8. A roll casting system according to claim 7, wherein said coolant supply means comprises an injecting means for injecting coolant between said first and second barriers and said first and second rotating rolls, respectively, in a direction substantially opposite a direction of rotation of said first and second rotating rolls, respectively.

9. A roll casting system according to claim 7, wherein said first and second barriers are positioned so as to define a dam along said first and second coolant flow paths, respectively.

10. A roll casting system comprising:

a molten metal supply means for providing a source of molten metal;

first and second rotating roll means for receiving molten metal from said molten metal supply means and for producing a solidified metal strip into a receiving area;

first and second barrier means disposed between said first and second rotating rolls, respectively, and said receiving area;

coolant supply means for supplying a continuous flow of coolant along a first and second coolant flow path bounded by said receiving area, said first and second rotating rolls, respectively, and said first and second barriers, respectively; and a sealing means for sealing said coolant supply means to said first and second rotating rolls, whereby coolant low is prevented from reversing its path of travel and exiting between said coolant supply means and said first and second rotating rolls.

11. A roll casting system comprising:

a molten metal supply means for providing a source of molten metal;

first and second rotating roll means for receiving molten metal from said metal supply means and for producing a solidified metal strip into a receiving area;

first and second barrier means disposed between said first and second rotating rolls respectively, and said receiving area;

coolant supply means for supplying a continuous flow of coolant along a first and second coolant flow path bounded by said receiving area, said first and second rotating rolls, respectively, and said first and second barriers, respectively;

a first nozzle body having two pairs of opposed first side walls and a bottom wall, said first nozzle body being positioned such that three of said first side walls sealingly contact said first rotating roll, and one of said first side walls is said first barrier means; and a second nozzle body having two pairs of opposed second side walls and a bottom wall, said second nozzle body being positioned such that three of said second side walls sealingly contact said second rotating roll and one of said second side walls is said second barrier means.

* * * * *

UNITED STATES PATENT AND TRADEMARK OFFICE

CERTIFICATE OF CORRECTION

PATENT NO. : 4,823,860

DATED : April 25, 1989

INVENTOR(S) : Wilhelm F. Lauener

It is certified that error appears in the above—identified patent and that said Letters Patent is hereby corrected as shown below:

Column 6, line 34, "disposed" should be -- disposing --.

Column 6, line 68, "moltOn" should be -- molten --.

Column 8, line 8, "low" should be -- flow --.

Column 8, line 15, between "said" and "metal", insert -- molten --.

Signed and Sealed this

Thirtieth Day of January, 1990

*Attest:*

JEFFREY M. SAMUELS

*Attesting Officer* *Acting Commissioner of Patents and Trademarks*